United States Patent [19]

Lewis

[11] Patent Number: 4,494,353

[45] Date of Patent: Jan. 22, 1985

[54] METHOD OF MANUFACTURING AND BUILDING PREFORMED MODULAR BUILDING WALL SECTIONS

[76] Inventor: Alvin W. Lewis, 82 Court St., Westfield, Mass. 01085

[21] Appl. No.: 380,275

[22] Filed: May 20, 1982

[51] Int. Cl.[3] ..... E09G 21/00

[52] U.S. Cl. ..... 52/741; 52/309.12; 52/354; 52/378

[58] Field of Search ..... 52/741, 309.12, 364, 52/354, 355, 371, 410, 378, 293, 383; 264/309, 32, 34; 425/DIG. 121

[56] References Cited

U.S. PATENT DOCUMENTS

| | | | |
|---|---|---|---|
| 1,524,808 | 2/1925 | Barry | 52/378 |
| 2,104,875 | 1/1938 | Levy | 52/354 |
| 2,104,876 | 1/1938 | Wetherbee | 52/354 |
| 2,131,465 | 9/1938 | Levy | 52/354 |
| 3,228,161 | 1/1966 | McCown | 52/410 |
| 3,352,076 | 11/1967 | Jones | 52/371 |
| 3,622,656 | 11/1971 | Dewey, Jr. | 264/309 |
| 3,676,973 | 7/1972 | Kellert | 52/364 |
| 3,744,194 | 7/1973 | Ramberg | 52/741 |
| 4,253,288 | 3/1981 | Chun | 52/741 |
| 4,342,180 | 8/1982 | Gibson et al. | 52/309.12 |

FOREIGN PATENT DOCUMENTS

| | | | |
|---|---|---|---|
| 0362575 | 12/1931 | United Kingdom | 52/741 |

*Primary Examiner*—Henry E. Raduazo

*Attorney, Agent, or Firm*—Ross, Ross & Flavin

[57] ABSTRACT

Building frame units and building structures using such frame-units as load bearing wall sections or wall panels are disclosed. The frame units comprise metal sections providing longitudinal frame members, each frame-members and interconnecting means define a rectangular skeletal frame with all residual spaces being closed by an infill of rigid insulation material providing a sealing and insulating barrier. The building structure is fabricated by assembling and erecting the frame units in a side-by-side interconnected relationship upon a pre-constructed base foundation with a special steel sill plate.

2 Claims, 15 Drawing Figures

10
12
14
16
18
40
44
48
52
60
62
64
68
70

METHOD OF MANUFACTURING AND BUILDING PREFORMED MODULAR BUILDING WALL SECTIONS

My invention is directed to a new and useful method of building homes and one story commercial buildings. The method employs structural refinements in apparatus for forming and building reinforced concrete walls by only the pneumatically-placed concrete method. The system is not designed to be used in any other way, nor is it to be construed that it may be used by the poured concrete method.

It is first to be noted that my invention, in broader aspects, may be embodied in any building construction involving the use of reinforced concrete, and it relates particularly to pneumatically-placed concrete walls. That is to say, and without intending to place undue limitations upon the scope of the instant invention, beyond what may be required by the state of the prior art, the particular embodiment may be briefly described as embracing the concept of a prefabricated frame assembly which is formed from a plurality of strategically interrelated modules or frame sections which will define a wall or a generally three dimensional configuration as in a housing, which modules support reinforcing rods to define an open network within which insulation panels or boards may be disposed. An array of such modules are then interjoined in an end-to-end or side-by-side manner to define the appropriate skeletised wall frame for the desired structural building design. Such skeletised arrangement provides the network to which the pneumatically-placed concrete known as gunite may then be applied to form the reinforced concrete structure.

The invention particularly concerns improvements in or relating to building systems and to the fabrication of building structures comprehending modules or wall sections in the form of skeletal frame units and to the closing off of such units each by a sheeting of an insulating barrier, to which barrier and skeletal reinforcing network concrete (gunite) may be quickly and efficiently applied to form a reinforced concrete structure.

A plurality of such frame assemblies are mounted in end-to-end relationship upon a slab or foundation wall, with suitably configured corner modules or frame assemblies for corners, and with reinforcing rods to form the array of frame assemblies, with insulation being placed internally thereof, all to provide a skeleton reinforcing network to which the concrete is then pneumatically applied to form the reinforced concrete structure.

The invention is directed particularly to the system of defining a skeleton reinforcing network to which the pneumatically placed concrete is applied in the formation of such as a reinforced wall or unitary building structure.

The wall modules or sections or panels will provide load-bearing upstanding walls and may have a modular size and construction consistent with standardized dimensions so as to be adoptable to present day modular assembly concepts.

The chief objects and purposes hereof are to provide advantageous structural and operational features in constructions of the class to which reference has been made so as to offer building units having the following inherent meritorius characteristics; first, engineering-wise, a uniqueness in design of coacting parts wherefor the components are coordinated for facile assembly and, when once assembled, are positively and securely retained in operative relationship so as to be not readily separable from each other, accidentally or otherwise; second, a susceptibility to easy installation, third, a high degree of safety in their use; fourth, a high degree of efficiency and dependability in their operational use; fifth, the securement of a higher degree of accuracy and greater degree of variety in the manner of work performed therewith than has heretofore been possible with prior devices known in the art; sixth, the attainment of a convenience of arrangement of parts and a flexibility or a capability of adjustment by which a large variety of work can be produced by means of the same device; seventh, the provision of constructions which are well adapted to withstand the usages to which building units are ordinarily subjected, and eighth, the provision of such other improvements in and relating to building units of the type above referred to as are hereinafter described and claimed.

Further objects are to provide a building system conformable to the desiderata of the preceding paragraph and offering specific improvements in its various operating instrumentatlities, which themselves are minimum in number, so that it is simple and compact in accordance with the demands and desires of manufacturers and purchasers alike and so as to provide distinct advantages in that it is distinctive in its appearance, practical in its value, durable in its organization, reliable in its operation, and efficient in its use.

It is believed that the gist of the invention will be clearly understood from the foregoing disclosure and accordingly, further analysis thereof at this point is considered unnecessary, as I have, in accordance with the provisions of the patent statutes, described the construction and principle of operation of my invention together with the apparatus which I believe to represent the best embodiment thereof, to the end that others can, by applying current knowledge, readily adapt it for various applications without omitting features which, from the standpoint of prior art, fairly constitute essential characteristics of its generic and/or specific aspects. The substitution of equivalents and other changes, modifications and alterations as circumstances may suggest or render expedient, are reasonably contemplated, the invention being susceptible of such without departing from its real spirit or underlying principles.

In the following description and in the appended claims, various components and details thereof will be identified by specific names for purposes of convenience. Although specific terms and expressions are employed for purposes of identifying various components, they are used in a generic and descriptive sense only. The phraseology or terminology herein employed is for the purpose of limitation and they are intended to be as generic in their application as the art will permit. They are not intended to exclude any reasonable equivalents of the features shown and described or portions thereof.

The invention is capable of receiving a variety of mechanical expressions, one of which is shown on the accompanying drawings, but it is to be expressly understood that the drawings are for the purpose of illustration only and are not to be construed as a definition of the limits of the invention, reference being had to the appended claims for that purpose.

Figures 1, 2, 3, 4, 5, 6, 7, 8:
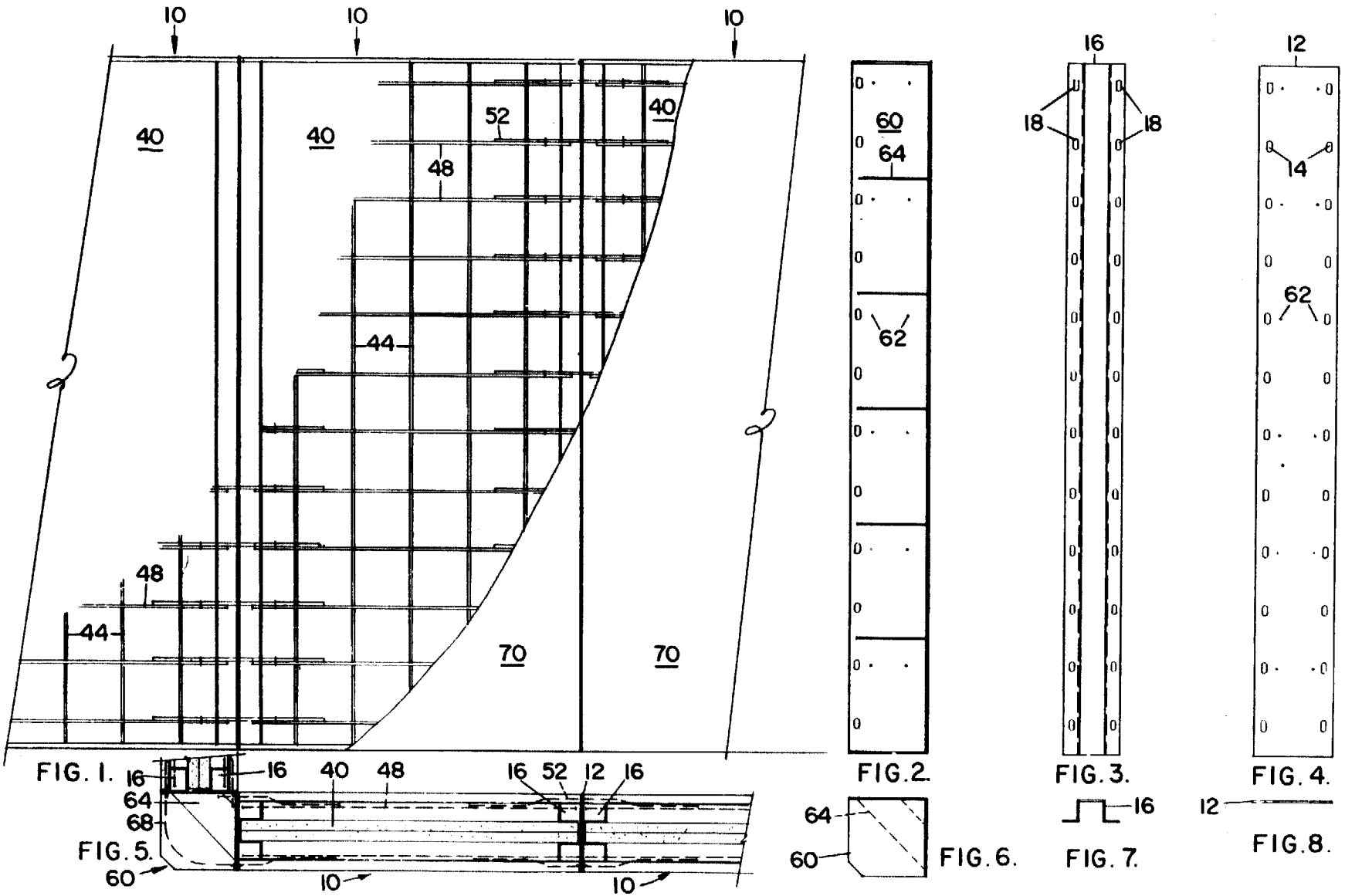
FIG. 1 illustrates, in fragmentary form, a side elevational view of a typical array of prefabricated building modules or frame units of the invention, assembled to form a skeletal assemblage to which pneumatically-placed concrete is applied.
FIG. 2 is a view in side elevation of a corner connector.
FIG. 3 is a view in side elevation of a hat channel.
FIG. 4 is a view in side elevation of a panel connector.
FIG. 5 is a plan view in section showing the relationship of a typical plurality of building modules or frame units, one of which is disposed in right angular relation to the two other building frame units with a corner unit disposed therebetween.
FIG. 6 is a view in section of the corner connector of FIG. 2.
FIG. 7 is a view in section of the hat channel of FIG. 3.
FIG. 8 is a view in section of the panel connector of FIG. 4.

The invention broadly defines a wall module or building frame unit for use as a wall section or panel of a building structure, which unit comprises a rectangular skeletal metallic frame built up of spaced-apart elongate frame members adapted to define vertically-extending members interconnected and braced by upper top and lower bottom horizontally-extending members.

According to this invention, prefabricated frame assemblies of modular form are easily erected and secured to each other, in a side-by-side relationship, so as to define a skeleton assembly for the reception of the pneumatically-applied gunite.

In the drawings, a plurality of wall modules or building frame units 10 are shown, assembled and connected in a side-by-side relationship as to one another, in the forming of a property wall or an external wall of a building structure.

Each module or building unit, in basic form, is of a rectangular skeletal metal frame comprised essentially of a vertically-disposed panel connector 12 at each of its opposite sides, there being one such panel connector between one module or building unit and the next adjacent module or building unit, although conceivably two such members could be employed at each joint, they being disposed in side-by-side adjacency.

Panel connector 12 is shown in FIGS. 4 and 8 as comprising a rectangular panel and is provided with elongated vertically spaced rod openings 14 adjacent opposite side edges thereof. Additional to functioning as a connector between adjacent modules, it serves as a primary stiffener for the completed wall structure and as a means for attaching any temporary braces which may be initially brought into play during the vertical aligning of the walls in attaining the obvious desideratum of insuring the correct and true vertical and horizontal dispositions of each module.

A vertically-disposed so-called hat channel 16 is of a generally squared U-shaped configuration, as shown in FIGS. 3 and 7, and is provided with vertically spaced rod openings 18 adjacent opposite side edges thereof. Each hat channel is brought into confrontation with and welded to its associated panel connector on each side of said panel connector. See FIG. 9, numbers 12 and 16.

Figure 9:
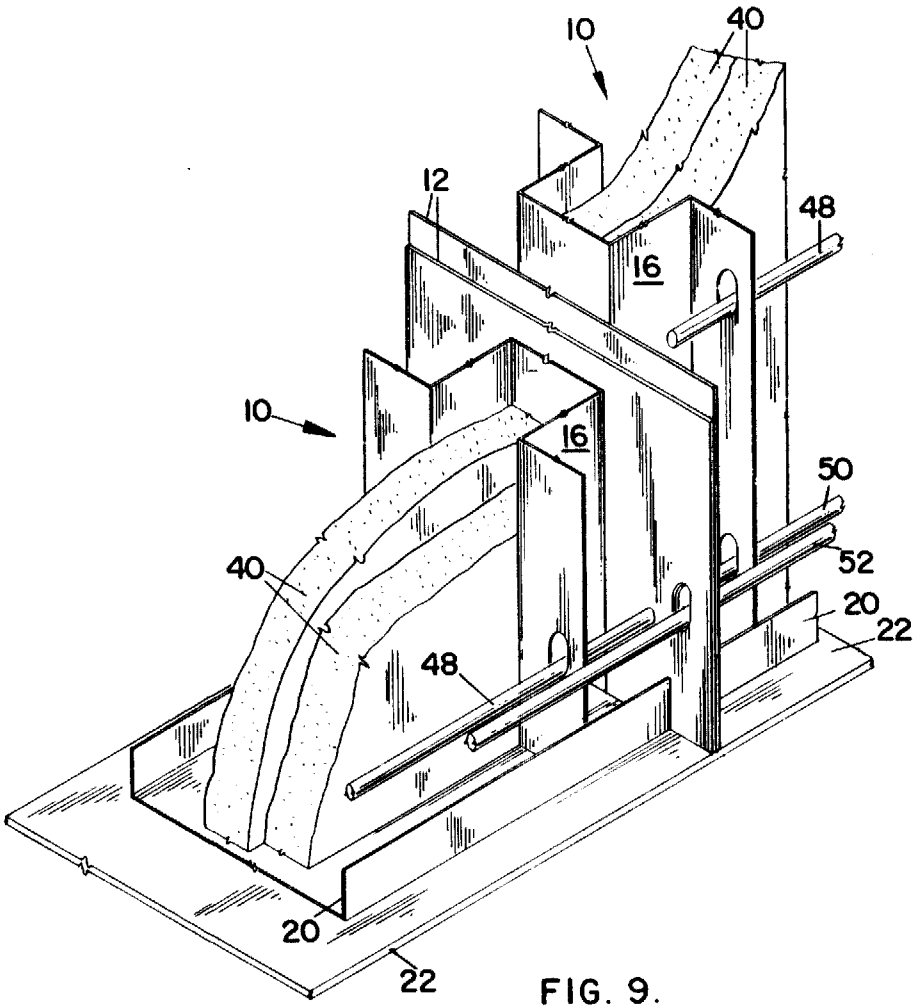
FIG. 9 is a fragmentary isometric view showing the relationship of a typical pair of building frame units in a side-by-side position with the interconnecting means therebetween and the seat for seating upon a foundation.
Figure 14:
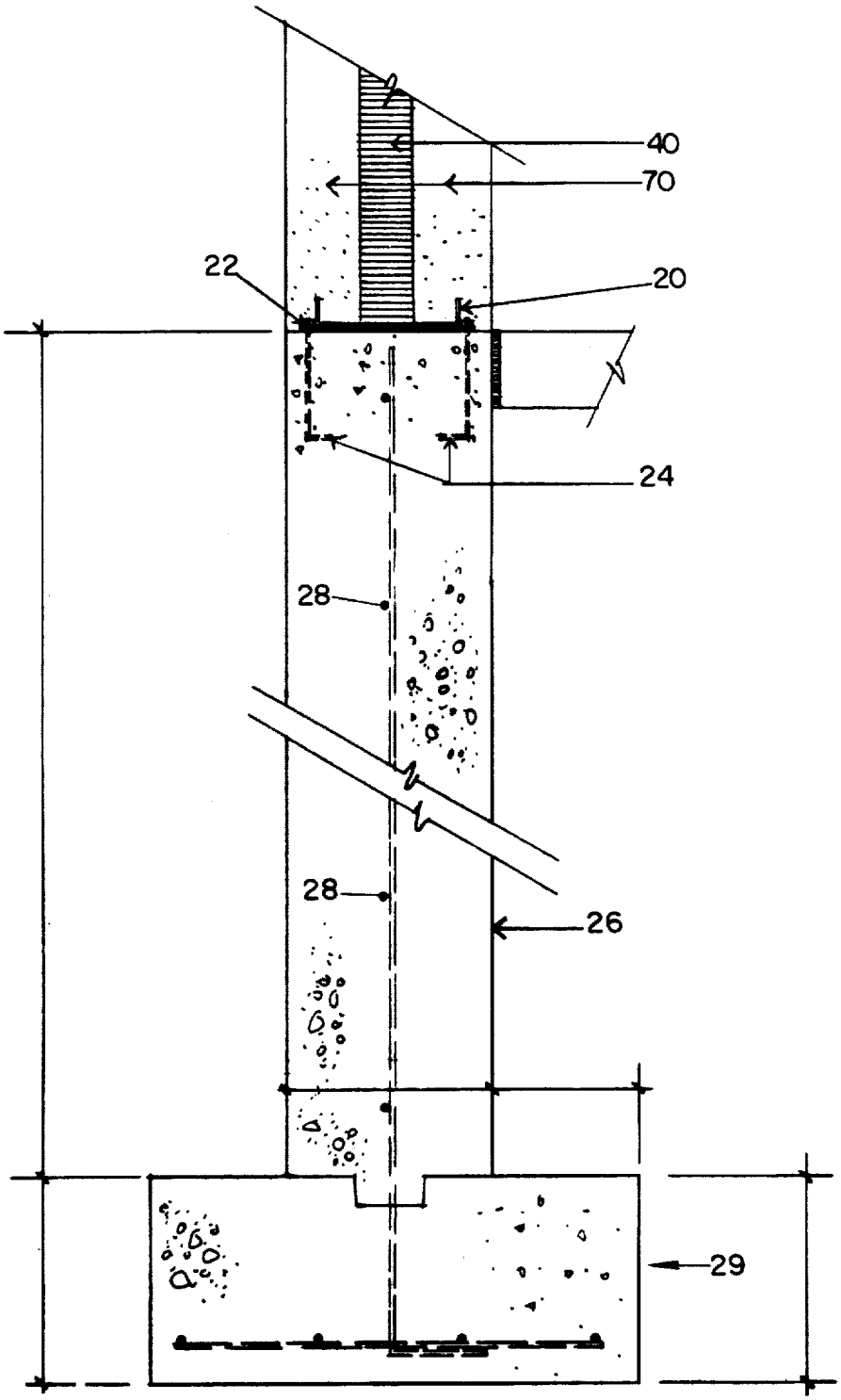
FIG. 14 is a typical section through a foundation wall and wall module mounted thereon.

The panel connectors 12 are strategically spaced along and welded to a bottom channel 20 of a generally squared U-shaped configuration, as best shown in FIG. 9, which bottom channel is seated upon and welded to a bottom plate or sill 22 which is bolted by anchor bolts 24 to a concrete foundation wall 26 reinforced by spaced vertically and horizontally disposed bars 28. Wall 26 may be supported upwardly from a footing 29, all as shown in FIG. 14.

Spaced between the opposite panel connectors 12 and hat channels 16 defining a particular module is a rigid insulating member 40 which is receivable within the square U of each opposite hat channel, all so as to be centrally and vertically-disposed relative to the module.

There may be a pair of such insulating members 40 disposed in face-to-face relation, as shown in FIG. 5, or there may be a single such member of a width adequate to be snugly received within the square U of each opposite hat channel and held firmly relative thereto. Likewise, there may be a single sheet of insulating member 40 extending from the bottom to the top of the frame or there may be a plurality of such members disposed in a stacked relation on top of each other in a vertical file, all as may be desired.

At the top of the module, a top channel 30 of generally C-shaped configuration, is seated upon and welded to the extremities of the panel connectors and a horizontally-disposed planar top plate 32 thereabove is bolted thereto.

On each side of insulating member 40, a plurality of spaced vertically-extending reinforcing bars 44 are provided so as to extend from bottom channel 20 to top channel 30, as may be observed in FIG. 1.

Figure 10:
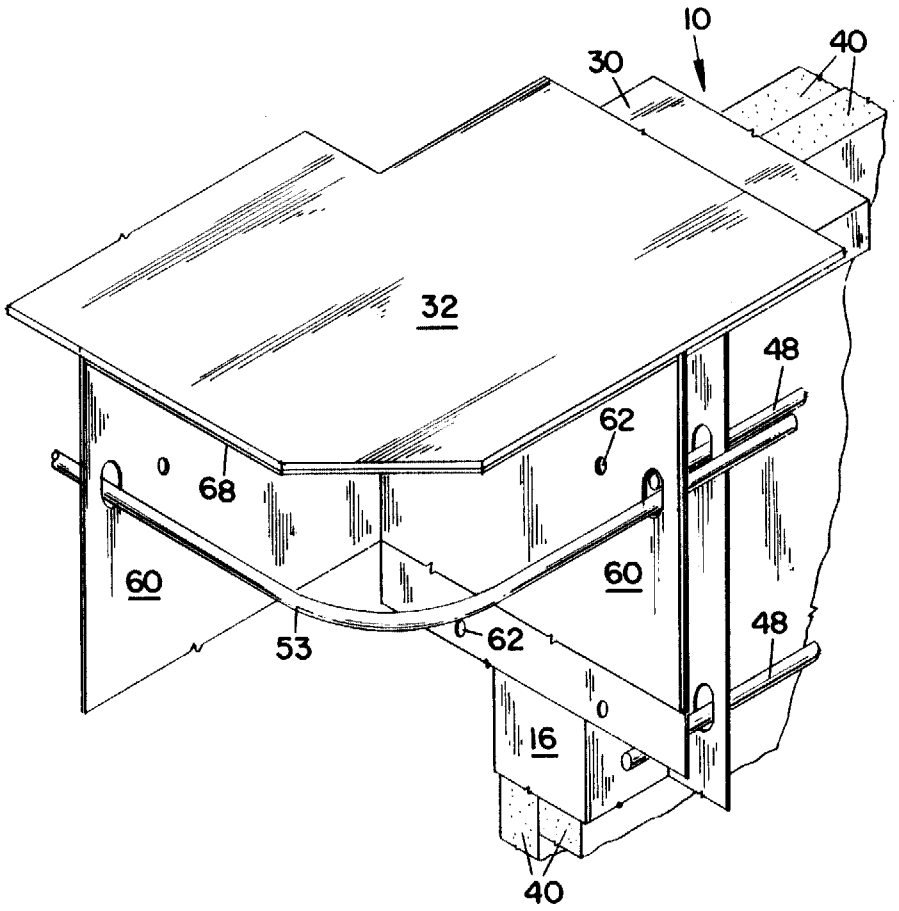
FIG. 10 is a fragmentary isometric view showing the relationship of a corner connector and a building frame unit and a cap for seating upon the top thereof.
Figure 12:
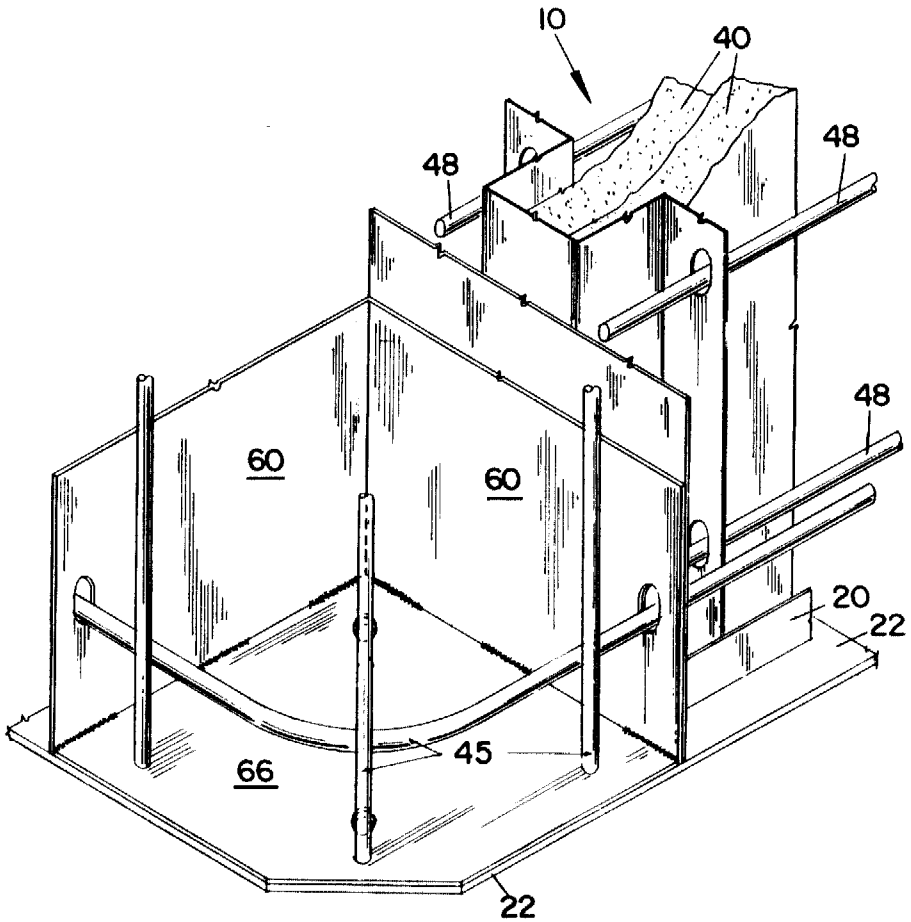
FIGS. 11 and 12 are fragmentary isometric views further illustrating details of the interconnection between a corner connector and building frame unit at a point at mid-height of the wall.
Figure 11:
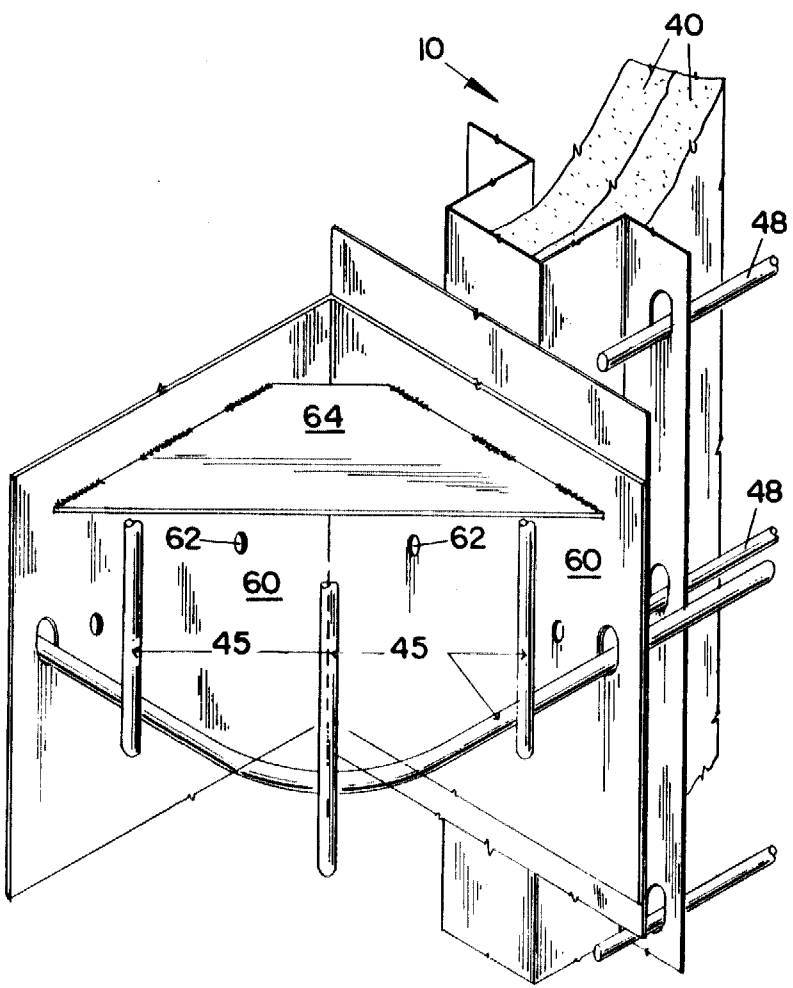

Also, on each side of insulating member 40, a plurality of spaced horizontally-extending reinforcing bars 48 are provided to extend between the opposite hat channels and more particularly into and through the respective rod openings thereof, as can be seen in FIG. 1, and other views such as FIGS. 10, 11 and 12.

Additionally, and between adjacent panels, additional horizontally-disposed reinforcing bars 52, called reinforcing connectors, may be provided, same being disposed through the aligned rod openings of the opposite panel connectors. See FIGS. 1, 5 and 9.

Where a corner is to be involved, a corner connector, generally indicated by 60, may be substituted for the respective panel connectors. Such corner connector consists of an L-shaped member with sides of equal width and with spaced elongated openings 62 through each side, and with a plurality of vertically-spaced horizontally-disposed stiffeners 64 extended between and welded to the opposed inside faces of the sides. See FIGS. 2 and 6.

A base corner plate 66, shown in FIG. 12, is also provided and is welded to L-shaped corner connector 60.

Similarly, a top corner plate 68, shown in FIG. 10, is provided and is welded to the L-shaped member 60.

In the instance of a corner for the building system involved, the corner connector 60 is bolted to the two adjacent panel connectors 12 in right angular relationship to each other as shown in FIG. 10.

With reference now to FIG. 9, a typical end-to-end relationship between adjacent building frame units 10 is shown with a pair of vertically-disposed panel connectors and wall stiffeners 12 being shown in back-to-back disposition with a hat channel 16 on opposite sides of the abutting panel connectors.

Figure 13:
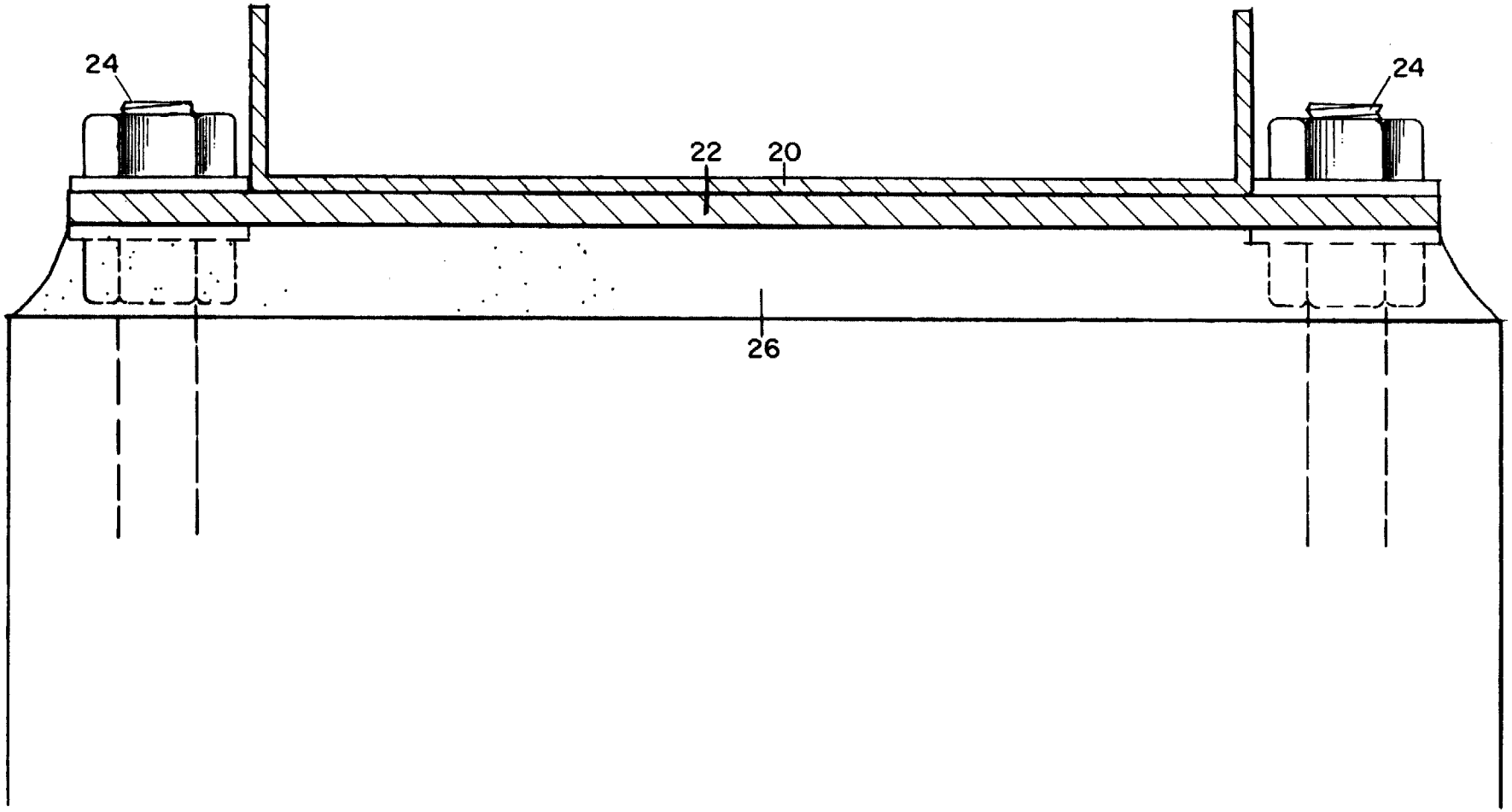
FIG. 13 is an enlarged view in section showing the detail of a continuous sill disposed upon and bolted to the top of the foundation wall.

The vertical members are seated upon and welded to C-shaped bottom channel member 20 which, in turn, seats upon horizontal bottom plate 22, there being a side edge of said plate extending outboard of channel member 20, on each side thereof for purposes of receiving anchor bolts 24 extended therethrough which are extended into the foundation wall 26 when same is poured, as shown in FIG. 13.

With further reference to FIG. 9, a pair of insulation members 40 disposed in face-to-face relationship is shown as assembled with each building frame unit.

Reinforcing rods 48 and reinforcing connectors 52 are also shown.

With reference to FIG. 10, the top of a typical frame unit 10 and of a corner unit are shown, with the C-shaped top channel 30 being shown with the horizontal top plate 32 here shown as having a configuration to adapt it to the corner situation being developed. Also shown are the bolt holes 62 employed to facilitate interconnection of the modular panels and corner connectors.

Also shown are a pair of insulating members 40 and hat channel 16 of the building frame unit and the L-shaped corner module 60 with typical interconnecting reinforcing bars 48 being extended therethrough.

In the case of the corner module, the reinforcing connector 53 will assume an arcuate configuration for extension through each right angular corner of the wall, as shown.

The FIG. 11 showing shows the corner unit and a building frame unit at mid-height of the wall and showing the employment of vertical reinforcing bars 45.

The FIG. 12 showing is another view of the corner unit and a typical building frame unit and shows the relationship of the vertical reinforcing bars 45 and the bottom plate of the corner unit which seats upon the steel sill, which sill is bolted to the foundation wall.

The horizontal top plate 32 may be of steel or wood for accommodation to bar joists or wooden rafters, as the case may be.

Figure 15:
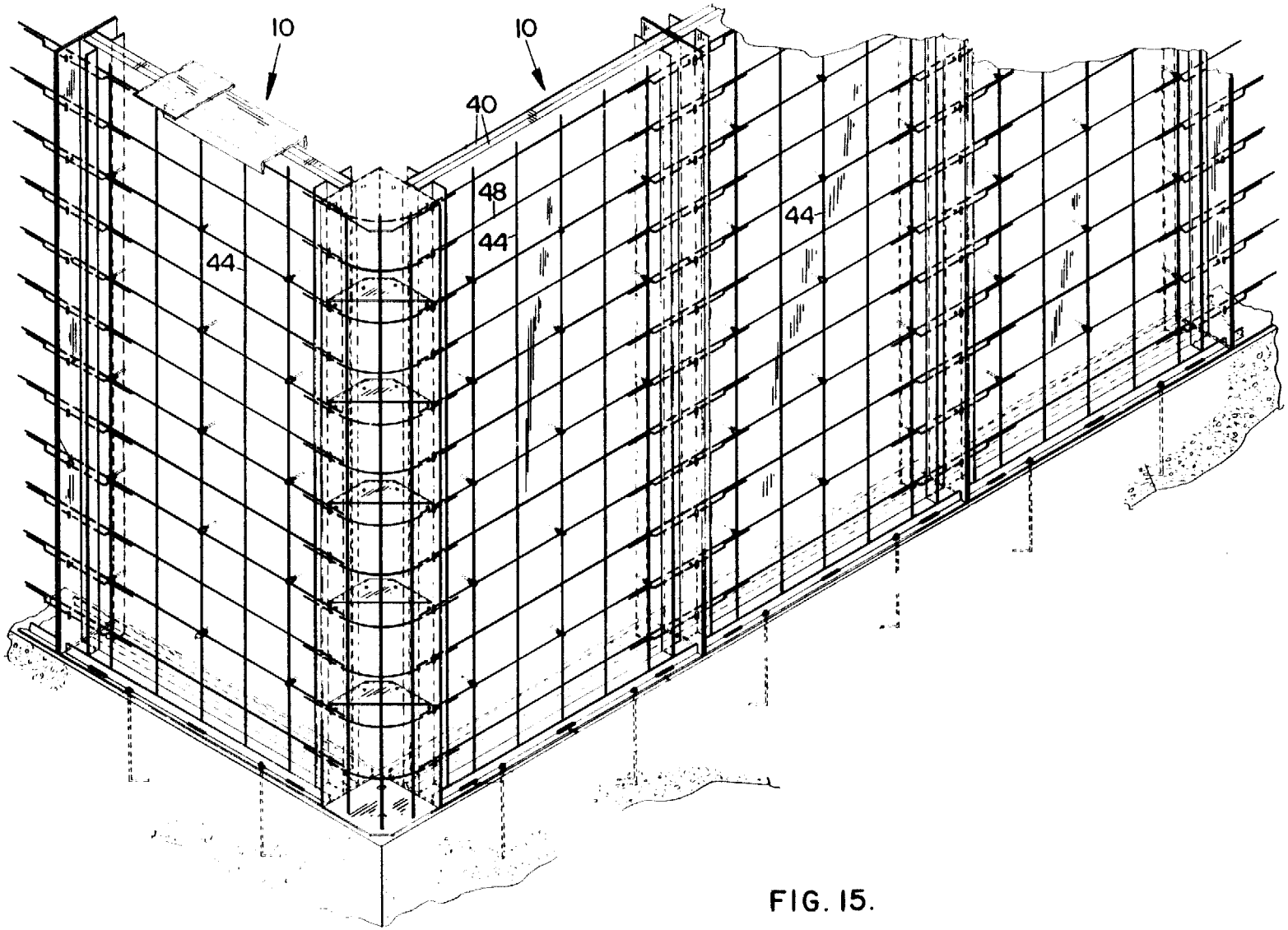
FIG. 15 is a fragmentary isometric view of the skeletized framework and cooperant insulation in situ before the application of the gunite.

In FIG. 15, I have shown, in fragmentary view, a skeletized framework and cooperant insulation in situ before the application of the gunite.

The metal framework having been erected, the construction is now ready to receive a charge of gunite 70 on opposite sides of the insulating member.

I claim:

1. A method of constructing a building load-bearing wall structure disposed upon a supporting base foundation, the method comprising the steps of:

prefabricating a plurality of elongate wall modules each comprised of an open network of spaced reinforcing bars extending along X and Y axes on opposite sides of and spaced from an insulation panel, forming a skeletal network of a frame assembly consisting of:

a. seating and welding a horizontally-disposed bottom channel to a sill bolted to a base foundation, b. seating and bolting a horizontally-disposed top plate upon a top channel, c. seating spaced pairs of vertically-disposed U-shaped hat channels in back-to-back relationship with a stiffening connector sandwiched between and welded to the hat channels of at least some of said pairs, disposing each wall module into a respective rectangular portion of the frame assembly defined by portions of the top and bottom channels and the respective adjacent hat channel at each side, nesting each edge of the insulation panel of each wall module in the defined U of the respective adjacent channel, welding the hat channels and connectors to the adjacent bottom and top channels, extending a plurality of horizontally-disposed reinforcing connecting rods through strategically-aligned openings in each arrangement of hat channels and connector and into the open network of reinforcing bars on opposite sides of the respective insulation panel of each adjacent wall module, and pneumatically applying gunite to the spaces between the channels on opposite sides of the insulation panel to define a reinforced concrete structure.

2. In the method of claim 1, the step of providing for the cornering of adjacent wall modules in angular relationship to each other including, the pair of hat channels at said corner being free of stiffening connectors and a vertically-disposed angularized corner connector with the vertically-disposed generally U-shaped hat channels being welded to the opposite outboard faces of the corner connector.

* * * * *